US008922105B2

(12) United States Patent
Nomoto

(10) Patent No.: US 8,922,105 B2
(45) Date of Patent: Dec. 30, 2014

(54) FLASH LAMP FOR A LAMP ANNEALING APPARATUS

(71) Applicant: Ushio Denki Kabushiki Kaisha, Tokyo (JP)

(72) Inventor: Daisuke Nomoto, Hyogo (JP)

(73) Assignee: Ushio Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/799,969

(22) Filed: Mar. 13, 2013

(65) Prior Publication Data

US 2013/0241388 A1 Sep. 19, 2013

(30) Foreign Application Priority Data

Mar. 19, 2012 (JP) ..... 2012-062462

(51) Int. Cl.

| | |
|---|---|
| ***H01J 7/30*** | (2006.01) |
| ***H01J 61/80*** | (2006.01) |
| ***H01J 61/90*** | (2006.01) |
| ***H01J 61/02*** | (2006.01) |
| ***H01J 61/35*** | (2006.01) |
| ***H01J 61/54*** | (2006.01) |
| *H01J 61/04* | (2006.01) |

(52) U.S. Cl.

CPC . *H01J 7/30* (2013.01); *H01J 61/80* (2013.01); *H01J 61/90* (2013.01); *H01J 61/025* (2013.01); *H01J 61/35* (2013.01); *H01J 61/547* (2013.01)

USPC ..... 313/234; 313/607; 313/594

(58) Field of Classification Search

USPC ..... 313/234, 113, 606, 607; 312/594

See application file for complete search history.

(56) References Cited

U.S. PATENT DOCUMENTS

| | | | | |
|---|---|---|---|---|
| 4,342,940 | A * | 8/1982 | Mrusko et al. | 313/594 |
| 5,884,104 | A * | 3/1999 | Chase et al. | 396/6 |
| 2007/0087492 | A1 * | 4/2007 | Yamanaka | 438/166 |
| 2012/0019119 | A1 * | 1/2012 | Ogino et al. | 313/113 |
| 2012/0070136 | A1 * | 3/2012 | Koelmel et al. | 392/416 |

FOREIGN PATENT DOCUMENTS

| | | | |
|---|---|---|---|
| JP | 2002-014393 | A | 1/2002 |
| JP | 2004-303889 | A | 10/2004 |

* cited by examiner

*Primary Examiner* — Tracie Y Green

(57) ABSTRACT

A flash lamp comprises an arc tube in which a pair of electrodes are provided there inside, a reflective film formed on an outer surface of the arc tube, a trigger wire arranged along the arc tube outside the reflective film, wherein ceramic material is used for the reflective film, and at an end of at least one of end portions of the arc tube, an end edge of the reflective film in a longitudinal direction is located in a front side of the electrode.

5 Claims, 6 Drawing Sheets

| | Separation distance from electrode | | Discharge start volt. |
|---|---|---|---|
| | L1 (mm) | L2 (mm) | (kV) |
| 1 | −8 | −8 | 2. 20 |
| 2 | −8 | 0 | 2. 15 |
| 3 | 0 | −8 | 2. 10 |
| 4 | 0 | 0 | 2. 10 |
| 5 | 0 | 6 | 2. 10 |
| 6 | 6 | 0 | 2. 00 |
| 7 | 6 | 6 | 1. 95 |
| 8 | 20 | 20 | 1. 95 |
| 9 | 40 | 40 | 1. 95 |
| 10 | No reflective coat | No reflective coat | 1. 95 |

FLASH LAMP FOR A LAMP ANNEALING APPARATUS

CROSS-REFERENCES TO RELATED APPLICATION

This application claims priority from Japanese Patent Application Serial No. 2012-062462 filed Mar. 19, 2012, the content of which is incorporated herein by reference in its entirety.

TECHNICAL FIELD

The present invention relates to a flash lamp used for semiconductor manufacturing or thin-film transistor manufacturing, and in particular relates to a flash lamp in which a reflective film is formed on an arc tube thereof.

BACKGROUND

Conventionally, a lamp annealing apparatus using a flash lamp, which is used for heat processing in semiconductor manufacturing or thin film transistor manufacturing, has been developed. For example, such a lamp annealing apparatus is used in a process for forming a shallow diffusion layer (p-n junction) in a silicon wafer surface layer (impurities activation for implanting ions). In this annealing process, it is necessary to avoid problems such as deformation of the profiles of ion-implanted impurities, and volatilization of the formed pattern, so as to acquire a good activated state of the impurities. Therefore, in this lamp annealing apparatus, it is necessary to suppress conduction of heat to lower part of a base plate, and to uniformly and certainly heat it to predetermined temperature. Similarly, in a thin film transistor manufacturing for a liquid crystal display panel, it is necessary to activate a semiconductor film formed on a base plate certainly and uniformly. It is required to suppress generation of expansion and contraction of a base plate or warpage thereof by preventing excessive heating to the base plate while accomplishing an annealing treatment, specifically in case where the base plate is made of glass.

In recent years, a flash lamp with a larger amount of light is demanded because the area of a semiconductor base plate or a glass base plate for a display becomes much larger (from (ϕ300 to ϕ450, and G4 to G10), and because usage thereof is expanded to other fields. Then, an increase of the amount of irradiation light from a lamp has been tried by providing a reflective film on an arc tube. A conventional technology, in which such a reflective film is formed on an arc tube of a flash lamp, is disclosed in Japanese Patent Application Publication No. 2002-014393. FIG. 6 shows the structure thereof, wherein the reflective film 12, which is made from a metal vapor-deposited film, is formed on part of an outer peripheral surface of an arc tube 11, and a heat radiating member 13 is provided thereabove. However, this technology relates to a low output flash lamp for a camera, and since, in a high output flash lamp which is used for a heat process, a thermal load is extremely large with respect to a reflective film, this technology cannot be applied to some other purpose as it is. That is, in the case of such a reflective film, which is made from a metal vapor-deposited film disclosed in Japanese Patent Application Publication No. 2002-014393, the film is overheated, and is oxidized or sublimated by a high-output lamp, so that there is a problem that the reflection function of the reflective film will be deteriorated by lighting the lamp even for a short time.

On the other hand, further improvement in lighting startability of such a flash lamp is also required. For example, Japanese Patent Application Publication No. 2004-303889 discloses technology in which a metal wire called a trigger wire on the outer surface of a flash lamp is provided, thereby improving the lighting startability of the lamp.

As a means for preventing damages to the reflective film disclosed in Japanese Patent Application Publication No. 2002-014393, it is considered that the constituent material of the reflective film may be changed from the metal vapor-deposited film to a ceramic material having higher heat resistance. However, although the problem due to the overheating is solved by using the ceramic material, if it is applied to a flash lamp having a trigger wire as disclosed in Japanese Patent Application Publication No. 2004-303889, there is a problem that the function of this trigger wire is impaired so that the lighting startability will get worse. The causes thereof are considered as set forth below. Although the trigger wire is formed outside the arc tube, this trigger wire is provided on a non-emission side of the arc tube, that is, on a side where the reflective film is formed, due to relation thereof with an output light. That is, since the reflective film will lies between the trigger wire and the arc tube, the electrical insulation properties of the arc tube and the trigger wire is increased by the reflective film, which is made from ceramic material, whereby even if voltage is applied to the trigger wire, it does not effectively act on the arc tube, so that the startability of the lamp will be prevented. Thus, the reflective film, which is made of ceramic material, causes a decrease of the trigger function, and worsens the startability of the lamp.

SUMMARY

In view of the problems of the above background technology, it is an object of the present invention to offer a configuration of a flash lamp, wherein in the flash lamp comprising: an arc tube, in which a pair of electrodes is provided; a reflective film formed on an outer surface of the arc tube; and a trigger wire arranged along the arc tube outside the reflective film, so that the lamp startability by a trigger wire is secured without damaging the reflective film due to heat from the high-output lamp, and without producing electrical insulation properties of the trigger wire and the electrode by the reflective film.

In a flash lamp according to embodiments of the present invention, ceramic material is used for the reflective film, and at an end of at least one end portion of the arc tube, an end edge of the reflective film in a longitudinal direction is located in a front side of the electrode. Moreover, the electrode in the one end portion may be an anode. Moreover, in the other end portion of the arc tube, an end edge of the reflective film in the longitudinal direction is located in a front side of the electrode.

In the flash lamp according to the embodiments of the present invention, since the reflective film is made from ceramic material, the flash lamp may be resistant to high temperature and fully tolerant in a heat processing use, and since the end edge in the longitudinal direction of the reflective film is located on the front side of the electrode, the electrical insulation properties due to the reflective film are not produced between the trigger wire and the electrode, whereby it is possible to secure the startability of the lamp. Thereby, it became possible to use such ceramic material, which is excellent in heat resistance as a reflective film material, without deteriorating the startability of the lamp. Moreover, the arrangement relation between the trigger wire and the end edge of the reflective film is secured on the anode side, thereby causing large potential between the trigger wire and the anode, and thereby increasing the startability of the lamp. Moreover, on the other side of the arc tube, the position relation of the end edge of the reflective film and the electrode is set to the relation which is described above, so that further startability of the lamp is improved.

BRIEF DESCRIPTION OF THE DRAWING

Other features and advantages of the present flash lamp will be apparent from the ensuing description, taken in conjunction with the accompanying drawings, in which.

DESCRIPTION

Figure 1:
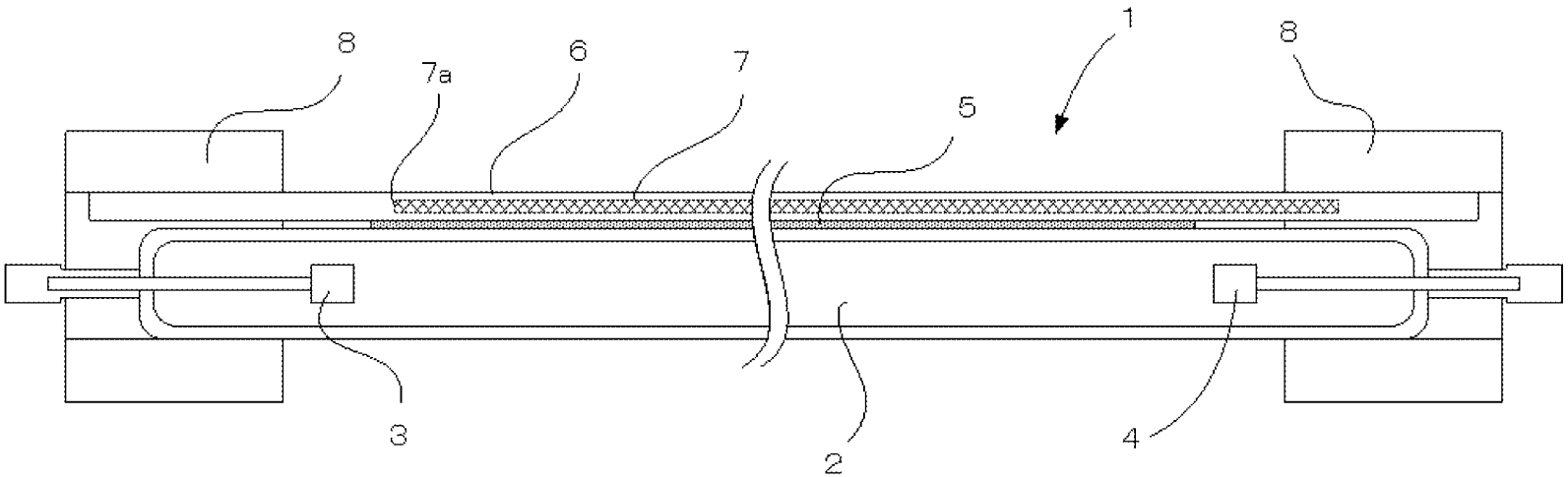
FIG. 1 is a sectional side elevation of the flash lamp of the present invention.
Figure 2:
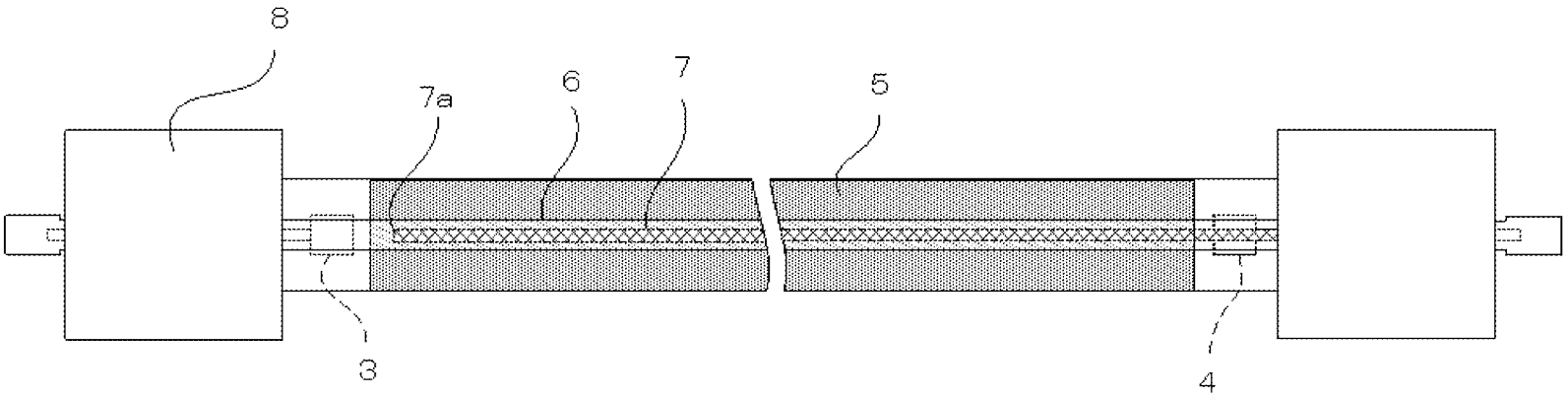
FIG. 2 is a top plan of FIG. 1.

As shown in FIGS. 1 and 2, a pair of electrodes 3 and 4, which face each other inside an arc tube 2, is arranged in a flash lamp 1 according to the present invention. In the present embodiment, the electrode 3 on the left hand side is an anode and the electrode 4 on the right hand side is a cathode. A reflective film 5 is formed on part of an outer surface of the arc tube 2, and the constituent material of this reflective film 5 is, for example, silica, alumina, ceramic material whose main component is nitride etc. or mixed material thereof. Moreover, although a trigger tube 6 is arranged along a longitudinal direction of the arc tube 2, the trigger tube 6 is provided outside the reflective film 5 so as not to block output light emitted from the lamp 1. In this trigger pipe 6, a trigger wire 7, which is made of tungsten, is inserted and arranged, and ends thereof is sealed, wherein the inside thereof is in vacuum state or in a state where inert gases is filled up, thereby preventing oxidization of the trigger wire 7. And this trigger tube 6 is attached to insulated blocks 8 and 8 at both ends thereof together with the arc tube 2.

As to relation between an end 7A of the trigger wire 7 and the electrode 3 in this type of a flash lamp, experience shows that it is the most effective when a separation distance thereof is approximately 5 mm. By the way, in order to start electric discharge between the electrodes of the flash lamp, high voltage is applied to the trigger wire 7, so that electric discharge occurs between the trigger wire 7 and the electrode at the beginning, whereby electric discharge is induced between the electrodes, and thus lighting of the lamp is comparatively easily carried out. And polarity of the high voltage applied to the trigger wire 7 is usually set to negative so that electric discharge etc. may not occur easily around this trigger wire 7.

On the other hand, since, on the anode side of the lamp, electricity is usually stored by a charge system such as a capacitor, positive voltage is applied to the anode by this charge system, even before lamp lighting. On the other hand, the cathode side is connected to the ground (GND). When the polarity of the trigger wire is made negative in this configuration, it is possible to make large the difference in potential between this trigger wire 7 and the anode, by the amount of positive voltage, which is applied to the anode so that it may be advantageous in the lighting startability of the lamp.

Figure 3:
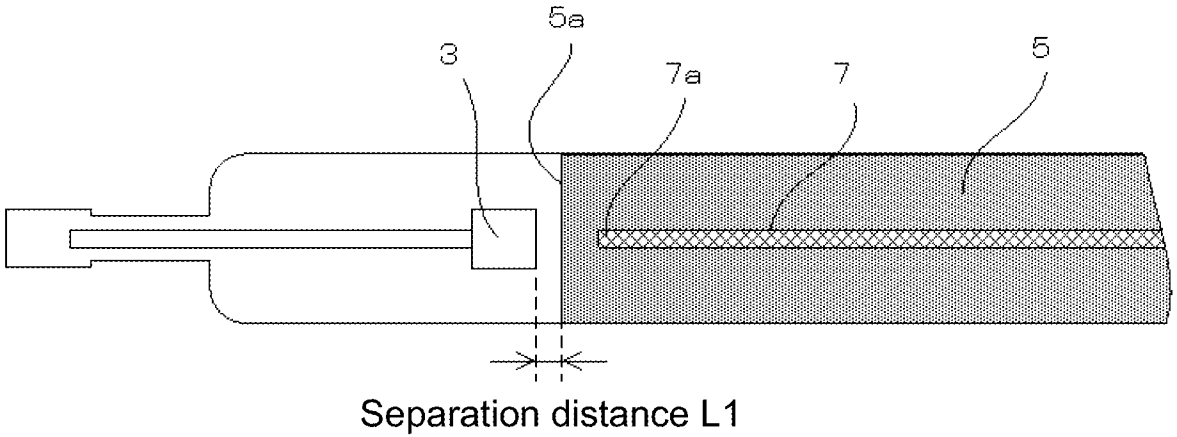
FIG. 3 is an enlarged view of a flash lamp of an embodiment of the present invention.

The position relation of the reflective film 5, the electrode (anode) 3, and the trigger wire 7 is shown in FIG. 3. In the embodiment of the present invention, an end edge 5*a* of the reflective film 5 in a longitudinal direction thereof is located on a front side of the electrode 3, i.e., on a side of a light emission space. In addition, in this specification, as long as there is no indication specially, a term "front" means the light emission space side in an axis direction of the tube axis, and a term "back" means the outside of the arc tube.

Figure 4:
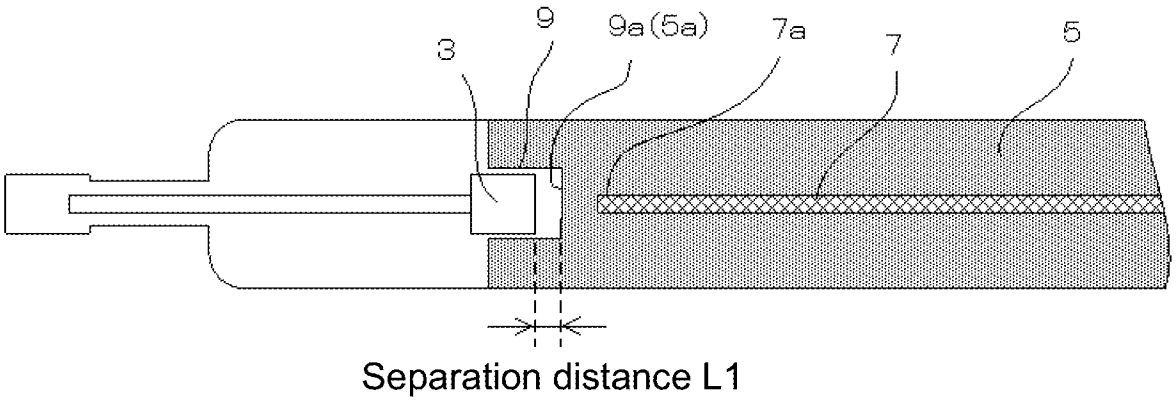
FIG. 4 shows another embodiment of the present invention.

Moreover, another embodiment is shown in FIG. 4. Although the entire reflective film 5 extends to the electrode portion, a cut-opening 9 is formed in an end portion of the reflective film 5, corresponding to the position where the electrode 3 exists. In such case, the end edge 5*a* of the reflective film 5 means a bottom part 9*a* of this cut-opening.

Figure 5:
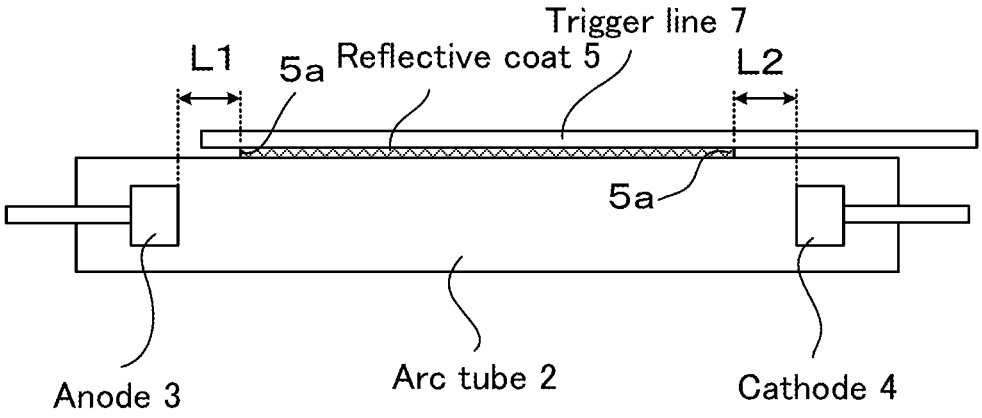
FIG. 5 is a diagram showing an experimental result.
Figure 6:
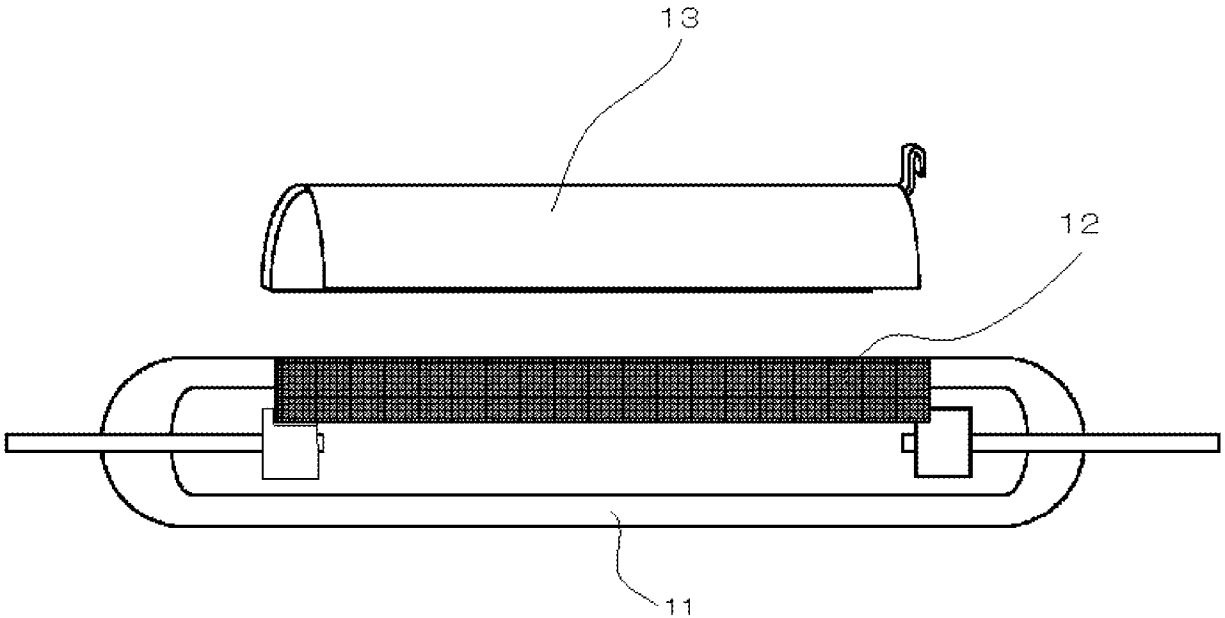
FIG.6 PRIOR ART
FIG. 6 is an exploded view of conventional technology.

Experiment was conducted in order to prove the advantageous effect of the embodiments according to the present invention. The configuration of the lamp used for this experiment is described below. An arc tube was made of quarts glass, was 576 mm in full length, 10.4 mm in inner diameter, and 13.0 mm in outer diameter. The reflective film was made from silica membrane. A distance between electrodes was 500 mm. The enclosed amount of xenon gas was 450 Torr. A trigger wire was made of tungsten, was 1 mm in outer diameter, and 537 mm in full length. In the experiment, as shown in FIG. 5, electric discharge start voltage of the lamp was observed in view of startability thereof, by examining the relation between the end edge 5*a* of the reflective film 5 and the separation distances L1 and L2 between the electrode (anode) 3 and the electrode (cathode) 4. In addition, minus (−) of L1 and L2 means that the end edge 5*a* of the reflective film 5 is located on a back side (outside of the arc tube) from a front face of the electrodes 3 and 4, that is, it is located so that the electrodes 3 and 4 may be covered thereby.

The experimental result is shown in a table of FIG. 5. In Example 1 (−8 mm, −8 mm) where the reflective film 5 extended so as to cover the electrodes 3 and 4 at both ends thereof, it was not practical since the electric discharge start voltage was high Next, in Examples 2 and 3 where the reflective film 5 did not cover an electrode at one of the end portions, electric discharge start voltage falls so that the effects were demonstrated in both examples. However, of these Examples 2 and 3, the Example 3 where the reflective film 5 was retreated toward the front side on the anode 3 side so as not to cover the anode 3, is more effective in voltage drop. Furthermore, as the end edge 5*a* of the reflective film 5 is retreated from the electrodes 3 and 4 so as to be located on the front side, the electric discharge start voltage will be drop further. And if the distance L from the electrode exceeds 6 mm, it will become equivalent to Example 10 where there is no reflective film. From the above, it is found that it is advantageous to locate the end edge 5*a* of the reflective film 5 on the front side of the electrode 3 and 4. Specifically, by making configuration in such a manner on the anode side, it is found that the fall of an electric discharge start voltage is remarkable.

In addition, the upper limit of the separation distance L between the end edge 5*a* of the reflective film 5 and the electrodes 3 and 4 will be determined based on relation between the fact that further decrease of electric discharge state voltage was not observed when it exceeds 6 mm so that it became equivalent to the case where there was no reflective film, and the state of the deterioration of the inherent reflective function of the reflective film. Moreover, from the above, in the embodiment shown in FIG. 4, it is configured that a decrease of the electric discharge start voltage can be expected while the reflection function is secured to the fullest extent. In addition, although the examples, where the trigger wire 7 is enclosed in the trigger tube 6, is explained above, it is not limited to the configuration. Of course, the trigger wire may be independently provided to extend along the arc tube 2.

According to the flash lamp applied to the present invention, as explained above, since the reflective film, which is made from ceramic material, is formed on the outer surface of the arc tube, and the end edge of the reflective film in the longitudinal direction is located on the front side of the electrodes at least one of the end portions of the arc tube, the insulation action by the reflective film is suppressed to the minimum, and electric discharge start voltage is made small whereby the improvement effect of the startability due to the trigger wire can be fully secured. In such a way, ceramic material, which is excellent in heat resistance, can be used as the reflective film constituent material. Moreover, the electric discharge start voltage can be dropped still more effectively by locating the end edge of the reflective film on a front side of the anode on the anode side.

The preceding description has been presented only to illustrate and describe exemplary embodiments of the present flash lamp. It is not intended to be exhaustive or to limit the invention to any precise form disclosed. It will be understood by those skilled in the art that various changes may be made and equivalents may be substituted for elements thereof without departing from the scope of the invention. In addition, many modifications may be made to adapt a particular situation or material to the teachings of the invention without departing from the essential scope. Therefore, it is intended that the invention not be limited to the particular embodiment disclosed as the best mode contemplated for carrying out this invention, but that the invention will include all embodiments falling within the scope of the claims. The invention may be practiced otherwise than is specifically explained and illustrated without departing from its spirit or scope.

What is claimed is:

1. A flash lamp comprising:

an arc tube in which an anode and a cathode are provided thereinside, a reflective film formed on an outer surface of the arc tube, a trigger wire arranged along the arc tube outside the reflective film, wherein polarity of voltage applied to the trigger wire is set to negative, wherein ceramic material is used for the reflective film, and at one of end portions of the arc tube which is on an anode side, an end edge of the reflective film in a longitudinal direction is located in front of the anode.

2. The flash lamp according to claim 1, wherein at the other end portion of the arc tube, an end edge of the reflective film in the longitudinal direction is located in front of the cathode.

3. The flash lamp according to claim 1, wherein a distance between the edge of the reflective film an end of the first electrode is substantially 6 mm.

4. A flash lamp comprising:

an arc tube in which an anode and a cathode are provided thereinside, wherein positive voltage is applied to the anode and the cathode is connected to a ground, a reflective film formed on an outer surface of the arc tube, a trigger wire arranged along the arc tube outside the reflective film, wherein ceramic material is used for the reflective film, and at one of end portions of the arc tube which is on an anode side, an end edge of the reflective film in a longitudinal direction is located in front of the anode.

5. A flash lamp, which is used for a heat process, comprising:

an arc tube in which first and second electrodes are provided thereinside, a reflective film formed on an outer surface of the arc tube, a trigger wire arranged along the arc tube outside the reflective film, wherein ceramic material is used for the reflective film so that the reflective film may not be damaged due to heat caused by lighting the flash lamp in the heat process, and at one of end portions of the arc tube which is on a first electrode side, an end edge of the reflective film in a longitudinal direction is located in front of the first electrode, so that a stability of the flash lamp may not be prevented by an electrical insulation properties due to the reflective film.

* * * * *